US005876769A

United States Patent [19]

Dowden et al.

[11] Patent Number: 5,876,769

[45] Date of Patent: Mar. 2, 1999

[54] HEATED SOAP MOLD DEVICE FOR RECYCLING SOAP BAR REMNANTS

[76] Inventors: Billy Dowden; Shelly Dowden, both of 135 Carolina, Lumberton, Tex. 77657

[21] Appl. No.: 690,785

[22] Filed: Aug. 1, 1996

[51] Int. Cl.[6] ..... B28B 11/00

[52] U.S. Cl. ..... 425/318; 425/395; 425/398; 425/408; 425/412; 425/419; 264/DIG. 69

[58] Field of Search ..... 425/318, 407, 425/410, 422, 52, 84, 395, 398, 408, 412, 419; 264/DIG. 69

[56] References Cited

U.S. PATENT DOCUMENTS

| | | | |
|---|---|---|---|
| 1,540,186 | 6/1925 | Rispel et al. | 425/408 |
| 3,059,273 | 10/1962 | Blevins, Jr. et al. | 425/408 |
| 3,931,035 | 1/1976 | Brown . | |
| 4,035,122 | 7/1977 | Cavanaugh . | |
| 4,313,537 | 2/1982 | Collet . | |
| 4,344,529 | 8/1982 | Ibarzabal . | |

*Primary Examiner*—Jan H. Silbaush
*Assistant Examiner*—Kenneth M. Jones
*Attorney, Agent, or Firm*—Bush, Riddle & Jackson, L.L.P.

[57] ABSTRACT

A method and apparatus for forming a soap bar from remnants of used soap bars. A molding base defining an internal molding cavity is provided with a pivotal closure also defining an internal die cavity. A forming die is movably supported by the closure and is movable from a retracted position out of the molding cavity to an extended position within said molding cavity where the forming die applies mechanical pressure to the soap fragments. The forming die is receivable within the die cavity at its retracted position and has a concave die surface of a configuration for forming a portion of the soap bar. A die actuator extends through the closure and may be provided with a spring for retraction of the die or for urging the die in a direction for continuous application of molding force to the forming die for a sufficient period of time for adhering and forming the soap bar fragments so as to define a resulting soap bar for subsequent conventional use. The molding base may be heated to accomplish heat softening of the soap fragments so that the soap fragments will adhere to one another and can be efficiently molded to define a finished soap bar for conventional use.

11 Claims, 2 Drawing Sheets

HEATED SOAP MOLD DEVICE FOR RECYCLING SOAP BAR REMNANTS

BACKGROUND OF THE INVENTION

1. Field of the Invention

This invention relates generally to apparatus for molding multiple fragments of soap bars to form bars of soap fragments that can be utilized in the same manner as new soap bars for the purpose of bathing and other toiletry and general cleaning activities. More specifically, the present invention concerns soap bar molding apparatus that is heated to render soap fragments soft and capable of becoming solidified to form bars of soap. Even more specifically, the present invention concerns soap bar molding apparatus having spring urged molding characteristics that permits the substantially continuous force of a spring to apply force to a moveable molding platen and to soap fragments over a sufficient period of time to cause the soap fragments to adhere and form a soap bar.

2. Description of the Prior Art

It is well known that soap bars, when used for bathing and general cleaning activities, become smaller and thinner as the soap leaves the bar and goes into solution with the water with which it is used. After a time the soap bars will become sufficiently thin that they cannot be conveniently handled and manipulated without slipping away and dropping. Also, it is well known that very thin soap bars will tend to break easily while being handled so that after a time the only thing that remains of a typical soap bar is two or more soap bar fragments or remnants that are very difficult to utilize for the intended purpose of the soap. For the most part, these soap bar fragments are discarded. Since bar soap is a significantly expensive cleaning material and the discarding of soap bar fragments and remnants is financially undesirable, various attempts have been made, with limited success, for molding or otherwise forming such fragments into bars that can be used in conventional manner. One of the difficulties that has been encountered in mechanically induced molding of soap bar remnants is the difficulty of causing soap bar fragments to adhere to one another when brought together under mechanical force. Some soap materials tend to readily adhere when softened by water, but other soap materials are resistant to adherence even when water is applied to them. Also, even when soap bars are molded by application of mechanical force to soap bar remnants in a mold or press, there is a tendency for soap bar fragments to separate during normal use. It is desirable therefore to provide for efficient adherence and molding of soap bar fragments and remnants so as to form soap bars having essentially the same characteristics of use as new soap bars.

With specific regard to the patented prior art, U.S. Pat. No. 3,931,035 of Brown discloses a soap bar that is composed of a hollow shell of soap bar material defining a cavity that is filled with soap bar remnants and a congealed mass of soap solution. U. S. Pat. No. 4,035,122 of Cavanaugh discloses soap bar molding apparatus which receives soap bar fragments and which subjects them to mechanical compressive force, preferably in the presence of water to form the fragments into a solid bar of soap. U.S. Pat. No. 4,313,527 discloses a device for holding drying and repetitively dispensing a bar of soap. This patent is not concerned with the manufacture of a bar of soap from soap bar remnants. U.S. Pat. No. 4,344,529 of Ibarzabal discloses a combined soap holder and press which permits reforming soap bar remnants with a new soap bar so the same can be used together. The holder and press apparatus is provided with cam induced compression for development of sufficient force for remnant adherence to a new soap bar and is provided with a parting ejector for ejecting the soap bar from the molding compartment after the molding operation has been completed.

SUMMARY OF THE INVENTION

It is an important feature of the present invention to provide a novel method and novel apparatus for reclamation of soap bar fragments by adhering the soap bar fragments and by molding them to achieve a consolidated soap bar that may be used in conventional manner.

It is another feature of the present invention to provide a novel method and novel apparatus for reclamation of soap bar fragments which achieves softening of the fragments by application of heat and molding of the fragments by application of mechanical pressure to form a consolidated soap bar that may be used in conventional manner.

It is another feature of the present invention to provide a novel method and novel apparatus for reclamation of soap bar fragments which comprises a soap bar molding device having an internal molding chamber for receiving soap bar fragments and means for application of mechanical force to the soap bar fragments within the molding chamber over a prolonged period of time to cause the soap bar fragments to be adhered to one another and molded into a solid consolidated soap bar mass of the configuration determined by the internal configuration of the mold and a molding die.

It is an even further feature of the present invention to provide a novel method and novel apparatus for reclamation of soap bar fragments which incorporates an internal forming die which is moveable manually within the molding cavity by means of an externally located die actuator and which may be urged toward a retracted or extended position according to the needs of the user.

It is an even further feature of the present invention to provide a novel method and novel apparatus for reclamation of soap bar fragments which includes an actuator lock mechanism that permits locking of the die actuator in a position for application of substantially continuous mechanical pressure to soap bar fragments within the molding chamber thereof so as to cause adherence and molding deformation of soap bar fragments therein.

Briefly, the various features of the present invention are realized through the provision of a molding mechanism having a molding base defining an internal cavity of a configuration for molding a portion of a soap bar and being of a dimension for receiving a sufficient quantity of soap bar fragments for the molding of a soap bar. A closure element is mounted in movable assembly with the molding base and is movable from a closed position closing said molding cavity to an open position permitting access to the molding cavity for placing soap bar fragments into the molding cavity and for removing a formed soap bar from the cavity. A forming die is movably supported by the closure and is movable from a retracted position out of the molding cavity to an extended position within said molding cavity where the forming die applies mechanical pressure to the soap fragments. The forming die is receivable within a cavity within the closure and has a concave die surface of a configuration for forming a portion of the soap bar. A die actuation mechanism is provided for permitting manual actuation of the forming die any may be provided with a spring for substantially continuously applying molding force to the forming die for a sufficient period of time for adhering and forming the soap bar fragments so as to define a resulting soap bar for subsequent conventional use. The molding base of the apparatus may be provided with heating means such as a internal electrical coil heater or a fluid transfer heater to provide for heat induced softening of the soap fragments so that the soap fragments will readily adhere to one another and the multiple soap bar fragments can be readily molded to define a consolidated finished soap bar for subsequent use in conventional manner.

BRIEF DESCRIPTION OF THE DRAWINGS

The various objects and advantages of this invention will become apparent to those skilled in the art upon an understanding of the following detailed description of the invention, read in light of the accompanying drawings which are made a part of this specification and in which.

In the drawings

DETAILED DESCRIPTION OF PREFERRED EMBODIMENT

Figure 1:
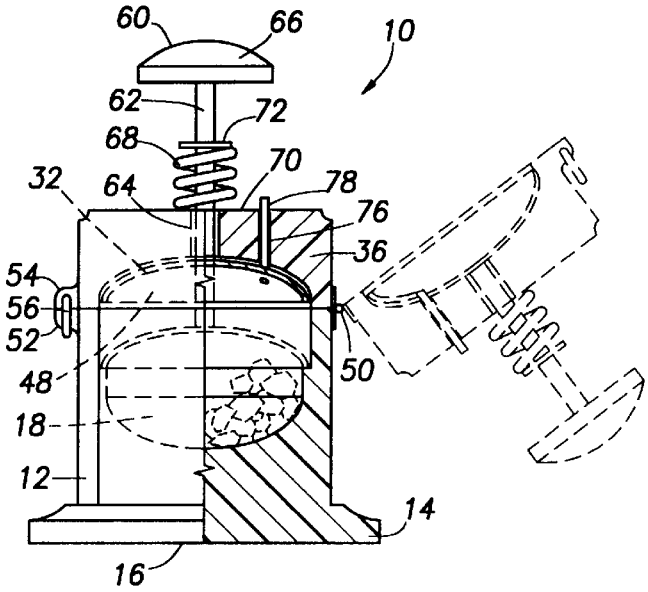
FIG. 1 is a half sectional view of apparatus for adhering and molding soap bar remnant fragments to form a soap bar.
Figure 2:
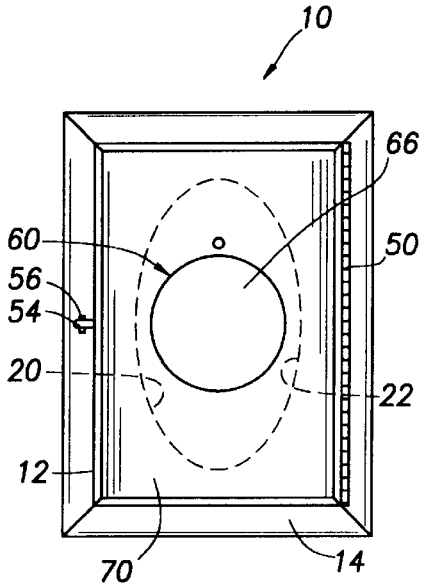
FIG. 2 is a plan view of the soap bar forming apparatus of FIG. 1.
Figure 3:
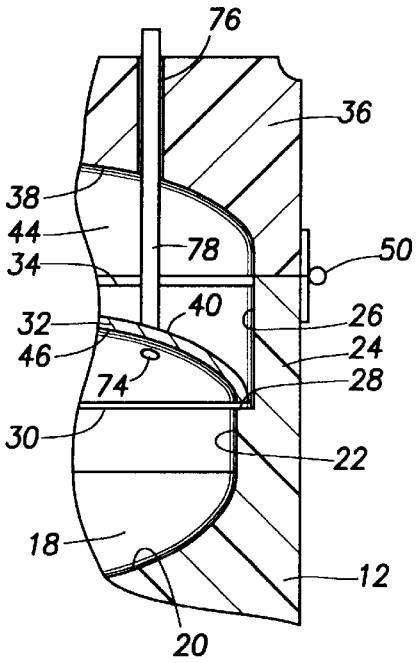
FIG. 3 is an enlarged partial sectional view of the soap bar forming apparatus of FIGS. 1 and 2, showing structural details thereof.

Referring now to the drawings and first to FIGS. 1–3, molding or pressing apparatus for adhering and forming soap bar fragments or remnants into a soap bar that can be utilized in normal fashion is shown generally at 10 and incorporates a base structure 12 having a lower stabilizing base section 14 defining a generally planer bottom surface 16 which adapts the base section for resting on a flat surface such as a kitchen counter top, for example. The base structure 12 also defines an internal cavity of a particular geometry for defining the lower and intermediate portions of a soap bar of pleasing configuration. As shown particularly in FIGS. I and 3, the cavity 18 has a lower curved surface 20 of substantially elliptical configuration and also having the substantially elliptical configuration shown in broken line in FIG. 2. As shown in greater detail in FIG. 3, the cavity 18 is also defined by an upright surface segment 22 which is of the generally elliptical configuration that is shown in broken line at 22 in FIG. 2. The upper portion of the wall structure 24 of the base section defines an internal upright wall surface 26 that is essentially of slightly larger configuration as compared with upright wall surface 22 but being of generally the same elliptical configuration as shown in broken at 22 in FIG. 2. An upwardly facing elliptical shoulder surface 28 is defined at the juncture of internal wall surface segments 22 and 26 and functions to define an upwardly facing internal stop surface for stopping contact by the lower end 30 of a forming die or press 32 that is movable within the upper portion of the housing structure that is defined by the base section 12. At its upper end the base section defines a generally planer surface 34.

The apparatus of FIGS. 1–3 is provided with a closure element 36 which is of internal geometry so as to define a curved chamber wall surface 38 that is of essentially the same geometric configuration of the upper curved surface portion 40 of the moveable forming die 32. Also, the closure element 36 defines an internal wall surface 42 at its lower extremity which is disposed in essentially coextensive relation with the internal wall surface 26 for the base section. This feature permits the forming die 32 to be raised to the extent that is wholly located within the internal chamber section 44 of the closure element 36 in the manner shown in FIG. 1. The moveable forming die also defines an internal curved, substantially elliptical surface 46 which defines an internal chamber 48 that is essentially of the desired configuration of the upper surface portion of a soap bar. Thus, when soap remnants or fragments are placed within the internal chamber defined by the base section 12 and the movable forming die 32 is moved downwardly until its lower end 30 shoulders against the upwardly facing shoulder surface 28, the soap bar remanent will be formed by mechanical pressure into a consolidated soap bar that may be then removed from the molding cavity and used in normal fashion. The closure element 36 is movably affixed to the molding base structure 12 by means of a hinge connection 50 to thereby render the closure element 36 moveable between a closed position as shown in full line in FIGS. 1 and 3 and an open position shown in broken line in FIG. 1. For the purpose of securing the closure 36 at its closed position, the apparatus is provided with a suitable latch mechanism. As shown particularly in FIG. 1, a suitable latch mechanism may conveniently take the form of latch projections 52 and 54 which extend, respectively, from the molding base structure 12 and the closure structure 36 as shown at 52 and 54. A latch element 56 which may conveniently take the form of a latch ring is pivotally connected to the latch projection 54 and is adapted to be received in locking relation about the latch projection 52. In the latched position shown in FIG. 3, the closure element 36 may not be opened until the latch element 56 is pivoted clear of the lower latch projection 52. It should be borne in mind that the latch mechanism shown in FIG. I is intended only to be taken as exemplary, it being within the spirit and scope of the present invention to incorporate any suitable latch mechanism that is capable of retaining the closure in its closed position.

It is desirable to achieve movement of the forming die 32 within the closure cavity 44 and the molding cavity 18 by means of actuator apparatus that is accessible externally of the soap molding apparatus. One simple means for accomplishing this feature may conveniently take the form of an actuator mechanism shown generally at 60 having an elongate actuator rod 62 which extends through an opening or passage 64 of the closure 36 and has its lower end in connection with the forming die 32. The actuator 60 is provided with a actuator head 66 having a curved upper surface which is engaged by a hand of a user so that manual form may be applied through the actuator head to the actuator shaft so as to drive the forming die 32 downwardly against soap fragments or remanent that located within the molding chamber. As shown in FIG. 1, the actuator shaft 62 is urged outwardly by a compression spring 68 which surrounds a portion of the actuator shaft so that its lower end is in engagement with the upper surface 70 of the closure and its upper end in force transmitting engagement with a stop member 72 that is suitably fixed to the actuator shaft. The spring stop member 72 may if desired may be composed of a washer having a central opening through which the shaft 62 extends. The washer may be seated against a downwardly facing circular shoulder of the shaft 62 or, it may be pinned, welded or otherwise fixed to the actuator shaft. When a downward force is applied to the actuator head 66, the spring 68 will be compressed as the actuator shaft 62 move downwardly. When manually applied force is removed from the actuator head, the compression spring will the drive the actuator shaft upwardly, thereby moving the forming die 32 upwardly to a position within the closure cavity 44. The compression spring 68 may be of any suitable character that will permit movement of the forming die from the retracting position shown in FIG. 1 to the fully extended position shown in broken line in FIG. 4.

As the forming die is moved downwardly by the actuator mechanism for mechanical compression of soap fragments located within the molding chamber, air pressure will tend to build up within the molding chamber below the forming die. It is desirable, of course, to vent the air pressure. For this reason, the forming die 32 defines one or more vent apertures 74 through which air is vented into the upper portion of the molding chamber and closure cavity. The closure cavity is also provided with one or more vent apertures 76 through which air may be vented to prevent undesired pressure build up. If desired, a vent tube 78 may be fixed to the forming die at the vent aperture 74 and may extend through the vent passage 76 of the closure element. If the molding cavity should contain an excessive volume of soap bar fragments, a portion of the soap and perhaps any liquid contained in the molding cavity can be expressed through the vent tube so that it will visually to the user to provide an indication that a solid soap bar has been formed even under circumstances where the forming die may not have shouldered against the upwardly facing internal shoulder 28.

In view of the foregoing, it is evident that the present invention is one well adapted to attain all the objects and features hereinabove set forth, together with other objects and features which are inherent in the apparatus disclosed herein.

As will be readily apparent to those skilled in the art, the present invention may be produced in other specific forms without departing from it spirit or essential characteristics. The present embodiment, is therefore, to be considered as illustrative and not restrictive, the scope of the invention being indicated by the claims rather than the foregoing description, and all changes which come within the meaning and range of the equivalence of the claims are therefore intended to be embraced therein.

Operation

The soap bar molding apparatus 10 with its closure 36 open as shown in broken line may be located in a bathroom, kitchen, utility room, etc. and soap fragments may be periodically placed therein. Typically the closure will be closed but perhaps not latched to keep the soap bar fragments from drying. When sufficient fragments have been accumulated to form a single soap bar, perhaps with the fragments softened by water, by heat or by any suitable means, the closure 36 is closed and latched. The user will then apply downward manual force on the actuator head 66 thereby driving the actuator shaft downwardly against the compression of the spring 68 and thereby forcing the forming die downwardly to cause compression and compaction of the soap bar fragments. As this is being done, any air that is present within the molding chamber will be expelled via the vent opening 74 or vent tube 78. Such downward movement of the forming die 32 may be continued until such time as the lower end 30 of the forming die shoulders out against the upwardly facing stop shoulder 28. When this has been accomplished, a soap bar will be formed from the consolidated and compressed soap bar fragments which may then used in normal fashion.

The forming die 32 may then be retracted from the position shown in FIG. 3 to the position shown in FIG. 1, so that is located entirely within the closure cavity 44. After this has been done, the latch element 56 may be moved to its release position and the closure 36 may be opened as shown in broken line in FIG. 1. The molding apparatus 10 may then be inverted to permit the formed soap bar to fall from the cavity 18 and into the hand of the user.

Figure 4:
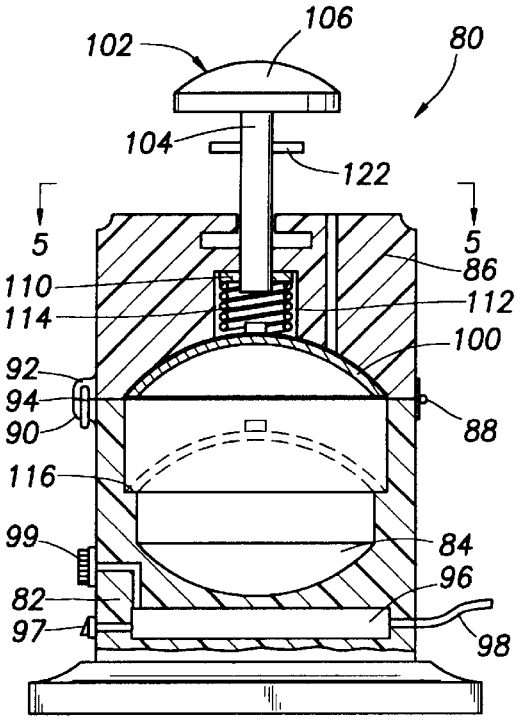
FIG. 4 is a sectional view of an alternative embodiment of the present invention incorporating heating and continuously urged force for adhering soap bar remnants and forming a soap bar therefrom.

After the internal cavity 84 of the molding base 82 has been sufficiently filled with soap bar remnants to warrant formation of a soap bar, the closure 86 is closed and latched such as is shown in FIG. 4. If formation of the soap bar is to occur solely by application of mechanical force, the actuator mechanism for the forming die will moved downwardly and rotated 90 degrees to latch it in place against the compression of the spring 114, thus preloading the compression spring. The free floating molding die will then substantially continuously apply mechanical force or pressure to the soap fragments 101 thereby causing them to adhere to one another and causing the resulting mass of soap fragments to be molded to the configuration of the molding chamber.

If it is intended that heat be applied during the molding process, the heater 96 will be energized to provide the molding base with sufficient heat for molding of a soap bar. After the molding operation has been completed, the heat source is then deenergized and the molding base is allowed to cool sufficiently to permit the resulting soap bar to solidify. After the soap bar has been completed in this manner, the closure will be unlatched and opened and the molding base inverted to permit the soap bar to fall from the molding chamber into the hand of the user.

Alternative Embodiment

Figure 5:
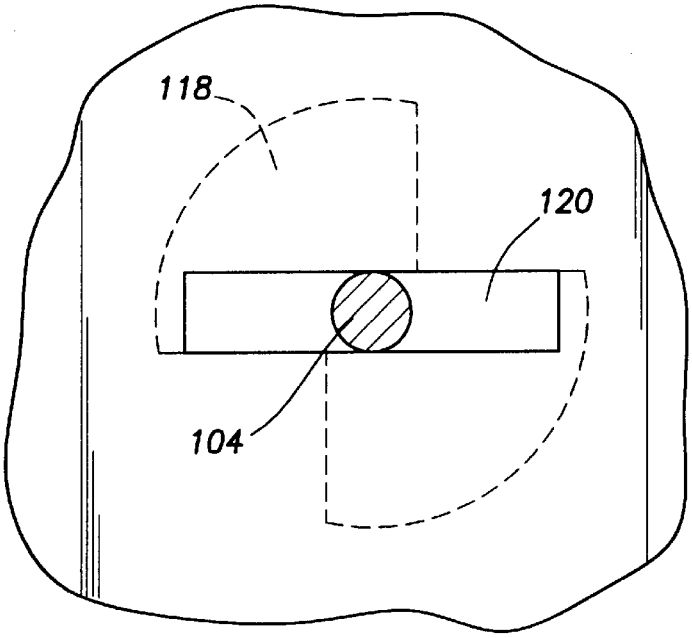
FIG. 5 is a partial plan view, taken along line 5—5 of FIG. 4 and showing the actuator lock mechanism thereof in detail.
Figure 6:
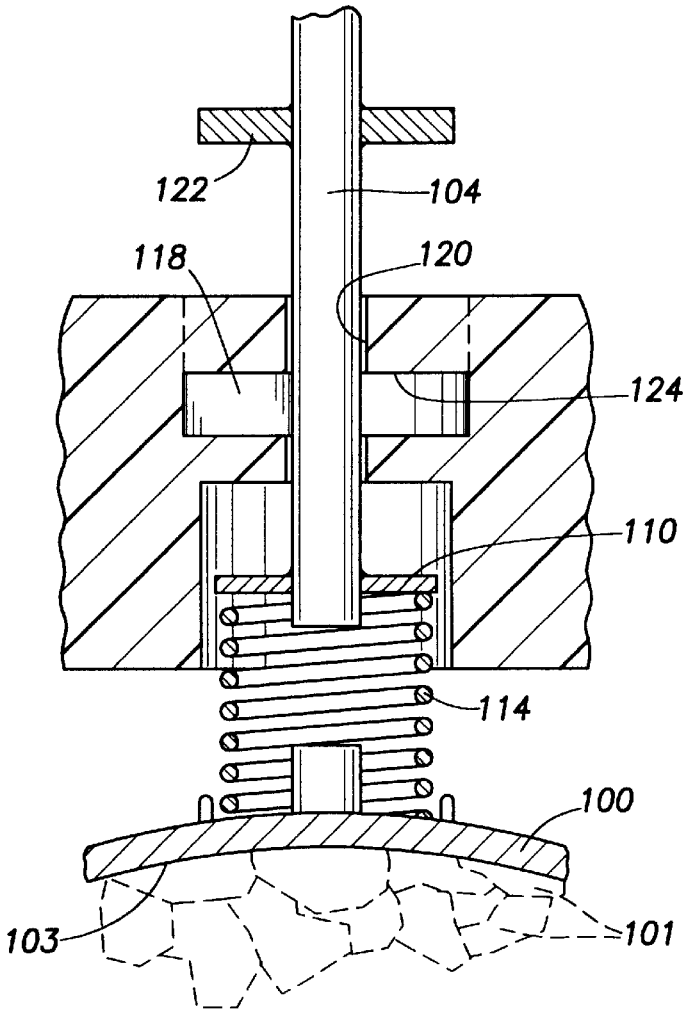
FIG. 6 is a fragmentary sectional view of the upper portion of the cover of the apparatus of FIG. 4, showing further details of the actuator lock and forming die urging means thereof.

Referring now to FIGS. 4 and 5, an alternative embodiment of the present invention is shown generally at 80. A molding base is provided as shown at 82 having an internal cavity 84 defined therein which may be of the same configuration and for the same purpose as described above in connection with FIGS. 1–3. This embodiment will also incorporate a closure element 86 that is moveably connected to the molding base by means of a hinge 88. The molding base and closure are provided with latch projections 90 and 92 and latch element 94 for securing the closure in its closed position as discussed above in connection with FIG. 1.

The molding base 82 is provided with an internal heater 96 which may be an electrically energized heater, as shown, having an electrical conductor circuit 98 for its energization from a suitable source of electrical energy and having a heater control switch 97 as shown in FIG. 4. In this case, the molding base 82 will be composed of a suitable material that will permit propagation of thermal energy throughout its structure so as to permit the surfaces defining the cavity 84 to be heated for softening of soap bar remnants located therein. The heating circuit may also incorporate any suitable temperature controller 99 which may be selectively adjusted to permit the heater to maintain a selected temperature. It should be borne in mind that the present invention is not intended to be restricted solely to electrically energized heating. For example, the heater 96 may be in the form of a tubular heating coil through which hot water or heated air may be circulated for transfer of heat to the molding base. As a further alternative, the molding base may be provided with an external heating sleeve to permit its external heating as desired.

It may be also desirable to provide an urging force on the forming die 100 of the soap bar molding apparatus so that fragments of soap bars located within the chamber 84 may be formed by substantially continuously compressing them over a sufficient period of time to accomplish adherence of the soap bar fragments to form a soap bar therefrom. One suitable means for accomplishing this feature may be a forming die actuator mechanism shown generally at 102 having an actuator shaft 104 to which an actuator head 105 is affixed. The actuator shaft extends through an opening 108 in the upper portion of the closure 86 and is provided with a spring force transmitting shoulder which may be conveniently confined by a washer member 110 that is fixed to the actuator shaft and located internally of a spring receptacle 112 of the closure. A compression spring 114 is located within the spring receptacle 112 with its upper end in engagement with the force transmitting shoulder of the washer 110 and its lower end bearing against the upper surface portion of the forming die 100. Thus, when the actuator shaft 104 is driven downwardly such as by manual force applied to the actuator head 106. The force transmitting shoulder will be driven downwardly along with the actuator shaft thereby preloading the compression spring 114. With the closure, closed and latched, and with a preload applied to the compression spring, the spring will apply substantially continuous downward force on the forming die 100 thereby transmitting this downward force to the soap bar fragments that are located within the chamber 84. As the soap bar fragments are formed, air and liquid are displaced, the compression spring will continuously move the forming die downwardly until a solid soap bar has been developed or until the forming die shoulders against the upwardly facing internal stop shoulder of the molding base.

To permit continuous application of spring force to the forming die 100, the actuator mechanism and closure are provided with means for securing the actuator shaft against movement. The upper portion of the closure defines an internal bayonet receptacle 1 18 having an entry slot 120 through which an actuator lock element is permitted to pass when the lock element is oriented in registry with the entry slot. For locking, the actuator shaft is moved downwardly and rotated to permit the actuator lock element 122 to move through the entry slot 120 and into the locking receptacle 118. Thereafter, the actuator shaft 104 will be rotated 90 degrees to position the lock element out of registry with the entry slot. When this is done, an internal upper locking shoulder 124 will restrain outward movement of the locking element 122 and its actuator shaft 104. When the actuator shaft is moved downwardly and locked in this manner, such downward movement will carry the force transmitting shoulder washer 110 downwardly thus causing compression of the spring 114. When this is done, the free floating forming die 100 will be urged downwardly by the spring thereby compressing the soap fragments 101. With the actuator shaft locked downwardly in this manner, the compression spring 114 will apply force to the forming die substantially continuously so that soap fragments, being of amorphous nature will be slowing and continuously adhered to one another by the mechanical pressure that is applied from the spring to the forming die. This continuous mechanical force either alone or together with the application of heat via the heater 96 will cause the soap fragments to be adhered to one another and to be conformed to the configuration of the molding chamber 84 and the lower curved surface 103 of the forming die.

As will be readily apparent to those skilled in the art, the present invention may be produced in other specific forms without departing from its spirit scope and essential characteristics. The present embodiment is therefore to be considered as illustrative and not restrictive, the scope of this invention being defined by the claims rather than the foregoing description, and all changes which come within the meaning and embraced therein.

What is claimed is:

1. Apparatus for forming a bar of soap from the fragmented remnants of used soap bars, comprising:

(a) a molding base defining an internal molding cavity of a configuration for molding a portion of a soap bar, said molding cavity being of a dimension for receiving a sufficient quantity of soap bar fragments for the molding (b) a closure element being in movable assembly with said molding base and having a closed position closing said molding cavity and an open position permitting access to said molding cavity;

(c) a free floating forming die being movably supported by said closure element and having a retracted position either out of said molding cavity or at least partially within said closure cavity and an extended position within said molding cavity, said forming die having a concave die surface of a configuration for forming a portion of the soap bar; and (d) a forming die actuator being movably connected with said closure element and having spring means-for substantially continuously applying spring force to said forming die for substantially continuously urging said forming die against soap bar fragments located within said internal molding cavity for adhering the soap bar fragments to one another and for forming a soap bar for subsequent conventional use.

2. The apparatus of claim 1, wherein:

(a) said closure element defining an internal closure cavity being exposed to said molding cavity when said closure element is located at said closed position thereof; and (b) at said retracted position said forming die being located at least partially within said closure cavity and at said extended position said forming die being located within said molding cavity, said forming die having an internal configuration for forming a portion of the soap bar.

3. The apparatus of claim 1, comprising:

(a) an actuator shaft movably extending through said closure element and being connected by said spring means with said forming die and having an actuator head exposed externally of said closure element for manual manipulation by a user; and (b) said spring means being disposed in force transmitting engagement with said actuator shaft and with said closure element, and urging said forming die toward said extended position thereof.

4. The apparatus of claim 1, wherein:

(a) said closure element being pivotally connected to said molding base and defining an internal closure cavity opening toward said molding cavity at the closed position of said closure element;

(b) at said retracted position said forming die being located at least partially within said closure cavity and at said extended position said forming die being located within said molding cavity, said forming die having a molding surface of a configuration for forming a portion of the soap bar;

(c) an actuator shaft movably extending through said closure element and being connected with said forming die and having an actuator head exposed externally of said closure for manual manipulation by a user; and (d) said spring means being a coil spring being located in encircling relation about said actuator shaft and at least partially within said internal cavity of said closure element, said coil spring means urging said forming die toward said extended position thereof and imparting a substantially continuous spring force to soap bar fragments located within said molding cavity to adhere the soap bar fragments and form a soap bar therewith.

5. The apparatus of claim 1, wherein said actuator means comprising:

(a) an actuator shaft movably extending through said closure element and being connected with said forming die and having an actuator head exposed externally of said closure element for manual manipulation by a user; and (b) said spring means being a coil spring encircling said actuator shaft and being disposed in force transmitting engagement with said actuator shaft and with said forming die, said coil spring urging said forming die toward said extended position thereof.

6. Apparatus for forming a bar of soap from the fragmented remnants of used soap bars, comprising:

(a) a molding base defining an internal molding cavity of a configuration for molding a portion of a soap bar, said molding cavity being of a dimension for receiving a sufficient quantity of soap bar fragments for the molding of a soap bar;

(b) a closure element being in movable assembly with said molding base and having a closed position closing said molding cavity and an open position permitting access to said molding cavity;

(c) a free floating forming die being movably supported by said closure element and having a retracted position out of said molding cavity and an extended position within said molding cavity, said forming die having a concave die surface of a configuration for forming a portion of the soap bar; and (d) a forming die actuator being movably connected with said closure element and having spring means for substantially continuously applying spring force to said forming die for substantially continuously urging said forming die against soap bar fragments located within said internal molding cavity for adhering the soap bar fragments to one another and for forming a soap bar for subsequent conventional use, said forming die actuator having an actuator shaft movably extending through said closure element and being connected by said spring means with said forming die and having an actuator head exposed externally of said closure element for manual manipulation by a user;

(e) a force transmitting shoulder being defined by said actuator shaft; and (f) said spring means being a compression spring encircling said actuator shaft and being interposed between said force transmitting shoulder and said forming die.

7. Apparatus for forming a bar of soap from the fragmented remnants of used soap bars, comprising:

(a) a molding base defining an internal molding cavity of a configuration for molding a portion of a soap bar, said molding cavity being of a dimension for receiving a sufficient quantity of soap bar fragments for the molding of a soap bar;

(b) a closure element being in movable assembly with said molding base and having a closed position closing said molding cavity and an open position permitting access to said molding cavity;

(c) a free floating forming die being movably supported relative to said closure element and having a retracted position out of said molding cavity and an extended position within said molding cavity, said forming die having a concave die surface of a configuration for forming a portion of the soap bar; and (d) a forming die actuator being movably connected with said closure element and having spring means for substantially continuously applying spring force to said forming die for substantially continuously urging said forming die against soap bar fragments located within said internal molding cavity for adhering the soap bar fragments to one another and for forming a soap bar for subsequent conventional use; and (e) means heating said molding base for softening soap bar fragments being located within said molding cavity to permit heat induced adherence of the soap bar fragments to one another and to promote formation of a soap bar Within said molding cavity.

8. The apparatus of claim 7, wherein:

said heating means comprising an electrically energized heating element being located within said molding base and being heated by a source of electrical energy.

9. The apparatus of claim 1, wherein:

(a) an actuator shaft movably extending through said closure and being connected with said forming die and having an actuator head exposed externally of said closure element for manual manipulation by a user; and (b) lock means being provided for said closure element and being positionable to lock said actuator shaft against movement relative to said closure element.

10. The apparatus of claim 9, wherein:

spring means being interposed between said actuator means and said forming die and with said actuator means locked relative to said closure imparting substantially continuous spring force to said forming die for application of substantially continuous forming die force to soap bar fragments being located within said molding cavity.

11. The apparatus of claim 9, wherein said lock means comprising:

(a) undercut locking slot means being defined by said closure element and having a downwardly facing restraining shoulder; and (b) said actuator shaft having a lock element being receivable in locking engagement within said undercut locking slot means and being disposed for locking engagement with said downwardly facing restraining shoulder for restraining movement of said actuator shaft.

* * * * *